US006086148A

United States Patent [19]

Gatto et al.

[11] Patent Number: 6,086,148

[45] Date of Patent: Jul. 11, 2000

[54] COLLAPSIBLE PICNIC TABLE

[75] Inventors: Jeffrey R. Gatto, Lyndhurst; Charles C. Myers, Akron, both of Ohio

[73] Assignee: The Little Tikes Company, Hudson, Ohio

[21] Appl. No.: 09/130,075

[22] Filed: Aug. 7, 1998

[51] Int. Cl.[7] ..... A47B 83/02; A47B 39/00; A47B 3/06

[52] U.S. Cl. ..... 297/159.1; 297/158.4

[58] Field of Search ..... 297/157.1, 158.3, 297/158.4, 159.1; 108/115, 162

[56] References Cited

U.S. PATENT DOCUMENTS

| | | | |
|---|---|---|---|
| 2,690,210 | 9/1954 | Holick | 155/123 |
| 2,748,837 | 6/1956 | Beller | 155/124 |
| 2,939,516 | 6/1960 | Drew | 155/124 |
| 3,273,936 | 9/1966 | Deavers | 297/159 |
| 3,276,815 | 10/1966 | Cardy | 297/159 |
| 4,415,199 | 11/1983 | Wright | 297/159 |
| 4,648,652 | 3/1987 | Van Kuren | 297/159 |
| 5,314,231 | 5/1994 | Otterbacher | 297/159 |
| 5,921,623 | 7/1999 | Nye et al. | 297/158.4 |

FOREIGN PATENT DOCUMENTS

| | | | |
|---|---|---|---|
| 665674 | 10/1965 | Belgium | 297/158.4 |
| 323862 | 6/1954 | Switzerland . | |

OTHER PUBLICATIONS

P. 50, Picnic table; Coleco Industries, Inc., Coleco Corporate Center, 999 Quaker Lane South, West Hartford, Connecticut 06110. Publication date 1986.

P. 7, Picnic table; Playskool/A Division of Hasbro, Inc., 1027 Newport Avenue, P. O. Box 1059, Pawtucket, Rhode Island 02862–1059.

P. 59, Picnic table; Fisher–Price, 620 Girard Avenue, East Aurora, New York 14052–1879. Publication date 1995.

P. 27, Picnic table; Today's Kids, 13630 Neutron Road, Dallas, Texas 75244. Publication date 1997.

Catalog page, Picinic table; Step2 Corporation, 10010 Aurora–Hudson Road, P. O. Box 2412, Streetsboro, Ohio 44241–0412. Publication date 1996.

Catalog page, Picnic table; Step2 Corporation, 10010 Aurora–Hudson Road, P. O. Box 2412, Streetsboro, Ohio 44241–0412. Publication date 1997.

Catalog page, Picnic table; The Little Tikes Company, 2180 Barlow Road, Hudson, Ohio 44236. Publication date 1997.

Catalog page, Picnic table; The Little Tikes Company, 2180 Barlow Road, Hudson, Ohio 44236. Publication date 1997.

Catalog page, Picnic table; The Little Tikes Company, 2180 Barlow Road, Hudson, Ohio 44236. Publication date 1997.

*Primary Examiner*—Laurie K. Cranmer
*Attorney, Agent, or Firm*—Foley & Lardner

[57] ABSTRACT

A collapsing table is disclosed comprising a table panel (12); two seat panels (14, 16); two support panels (18, 20); two brace members (22, 24); and two attachment clasp members (108). The support panels (18, 20) each pivotally couple to a respective end of the table panel (12) by means of pivot lugs (100, 102), each lug having flat surfaces (106) which prevent unintentional uncoupling. The support panels (18, 20) further slideably couple to the seat panels (14, 16) by means of coupling lugs (90, 92) reciprocally moving with a U-shaped guide track (60). The coupling lugs (90, 92) have flat surfaces (96) which engage detent protrusions (61) at the terminal ends (62, 64) of the guide track (60), which in conjunction with the non-linear geometry of the guide track (60), resists unintentional movement of the table from either the extended or collapsed conditions.

29 Claims, 11 Drawing Sheets

COLLAPSIBLE PICNIC TABLE

BACKGROUND OF THE INVENTION

1. Field of the Invention

The invention relates generally to collapsible tables and, more specifically, to collapsible picnic tables in which a seat is integrally connected to a table surface.

2. The Prior Art

Collapsible tables are well known in the prior art. Such tables typically provide for pivotal movement of the support legs from an extended position into a collapsed position against an underside of the table surface. In the collapsed condition, the table occupies much less space and is readily stored.

Moreover, tables of the type generally referred to as "picnic" tables have been achieved in a collapsing configuration. As with stand alone tables, the legs of such picnic tables collapse from an extended, freestanding, position into a storage, or collapsed, condition. A major distinction with picnic tables is that a pair of seats are integrated with the table into a single unit. As the picnic tables collapse, the table and seats move into a coplanar relationship of relatively narrow profile, greatly facilitating transportation and storage.

U.S. Pat. Nos. 4,648,652 and 2,690,210 are representative of state of the art collapsible tables of the "picnic" table configuration. As shown therein, a guide track is formed along an underside of the seats of the unit. End panels or legs are pivotally coupled at an upper end to opposite sides of the table top, and pivot inward and outward between a collapsed, storage, position and an extended, functional, position.

Each of the end panels or legs is adapted having a coupling portion which slidably engages the guide track beneath the seats. As the end panels are pivoted outward, the coupling portions travel along the guide track from an inward end to an outward end. Once positioned in the extended condition, the end panels are locked into place by means of brace bars which attach at opposite ends to the underside of the table top and to a respective end panel.

While the aforementioned state of the art collapsible picnic tables function well and have been well received by users, certain shortcomings inherent therein prevent such known tables from representing an ideal solution. First, the hardware associated with the hinge couplings and guide tracks, and the fasteners necessary for their assembly to the seats and table top, makes conventional collapsible picnic tables relatively expensive and cumbersome to assemble.

Secondly, the pivotal configuration of the end panels and the table top, in conjunction with the sliding connection between the end panels and the seats, creates pinch points that can capture and harm a user's fingers. This creates a safety concern, particularly when the table is sized intentionally for use by small children.

In addition, the tables described above rely solely upon the brace bars or members for keeping the end panels or legs in the extended condition. Structural failure or disattachment of such brace bars, therefore, can precipitate an unexpected collapse of the table and injury to the user. Such tables lack an effective, reliable locking mechanism that can back up the function of the brace bars in keeping the legs in their extended orientation.

Finally, conventional picnic tables are fabricated out of relatively heavy materials such as wood for the seats and table top, and metal for the associate hardware. Such materials make the table unit cumbersome to carry as well as expensive to manufacture. A light, durable, yet structurally sound, alternative to known collapsible picnic tables is, accordingly, a long sought objective.

SUMMARY OF THE INVENTION

The subject invention overcomes the aforementioned deficiencies in known collapsible picnic tables. A picnic table is achieved having a minimal number of component parts, each economically and readily produced of plastic by conventional blow molding processes. Assembly is accomplished without the need for hand tools or hardware. The table comprises a table top panel, two seat panels, two end panels, and a pair of brace members. Each end panel is pivotally coupled at a top end to an underside of the table top by a pair of oppositely projecting pivot lugs. Each pivot lug resides within a socket and defines the axis about which the end panel pivots between its storage and extended positions. The pivot lug is substantially cylindrically configured having radiussed surface portions separated by first and second oppositely directed flat surfaces. The flat surfaces of the pivot lug rotate into an opposition to sidewalls defining the socket when the end panel is in the extended and collapsed condition. In order to initiate rotation of the end panel between such conditions, resistance created between edges of the flat surfaces and the socket sidewalls must be overcome. The flat surfaces, therefore, creates resistance to the end panels moving from either the storage or the extended conditions.

Lateral portions of the end panels are captured in channels formed in the underside of the seat panels and reciprocally move therealong as the end panels move between the storage and extended conditions. A guide slot is formed in sidewalls defining each channel. The lateral poritions of the end panels provide coupling lugs which reside in the channel guide slots to mechanically couple the seat panels to the end panels.

Each coupling lug is configured to correspond to the pivot lugs described previously; namely, having radiussed circumferential surfaces separated by first and second oppositely projecting flat surfaces. The guide slot is substantially U-shaped having terminal ends separated by a bight portion. As the end panels pivot between the storage and extended positions, the coupling lugs travel along the guide slot between the terminal ends thereof At each end of the guide slots, the coupling lug is oriented to place the flat surfaces against the sidewalls defining the guide slot. Movement of the coupling lugs from such extremities of the guide slot encounters resistance caused by engagement of the edges of the flat surfaces against the slot sidewalls. The coupling lugs, in cooperation with the pivot lugs, thus tend to maintain the end panels in either their storage or extended conditions until such resistance is forcefully overcome. The U-shape of the guide slot facilitates the proper orientation of the flat surfaces of the coupling lugs.

Accordingly, it is an objective of the invention to provide a collapsible picnic table having relatively few component parts.

A further objective is to provide a collapsible picnic table which folds into a substantially flat configuration for storage.

Yet a further objective is to provide a collapsible picnic table having integral locking mechanisms for maintaining the table in either the extended or the collapsed state.

An additional objective is to provide a collapsible picnic table having cooperative, redundant locking pivot and slide joints.

Another objective is to provide a collapsible picnic table capable of assembly without hand tools or assembly hardware.

Still a further objective is to provide a collapsible picnic table having no pinch points created by pivotal or slide couplings.

Yet another objective is to provide a collapsible picnic table which is economically and readily manufactured, transported, and assembled.

These and other objectives, which will be apparent to those skilled in the art, are achieved by a preferred embodiment which is described in detail below and illustrated in the accompanying drawings.

DESCRIPTION OF THE PREFERRED EMBODIMENT

Figure 1:
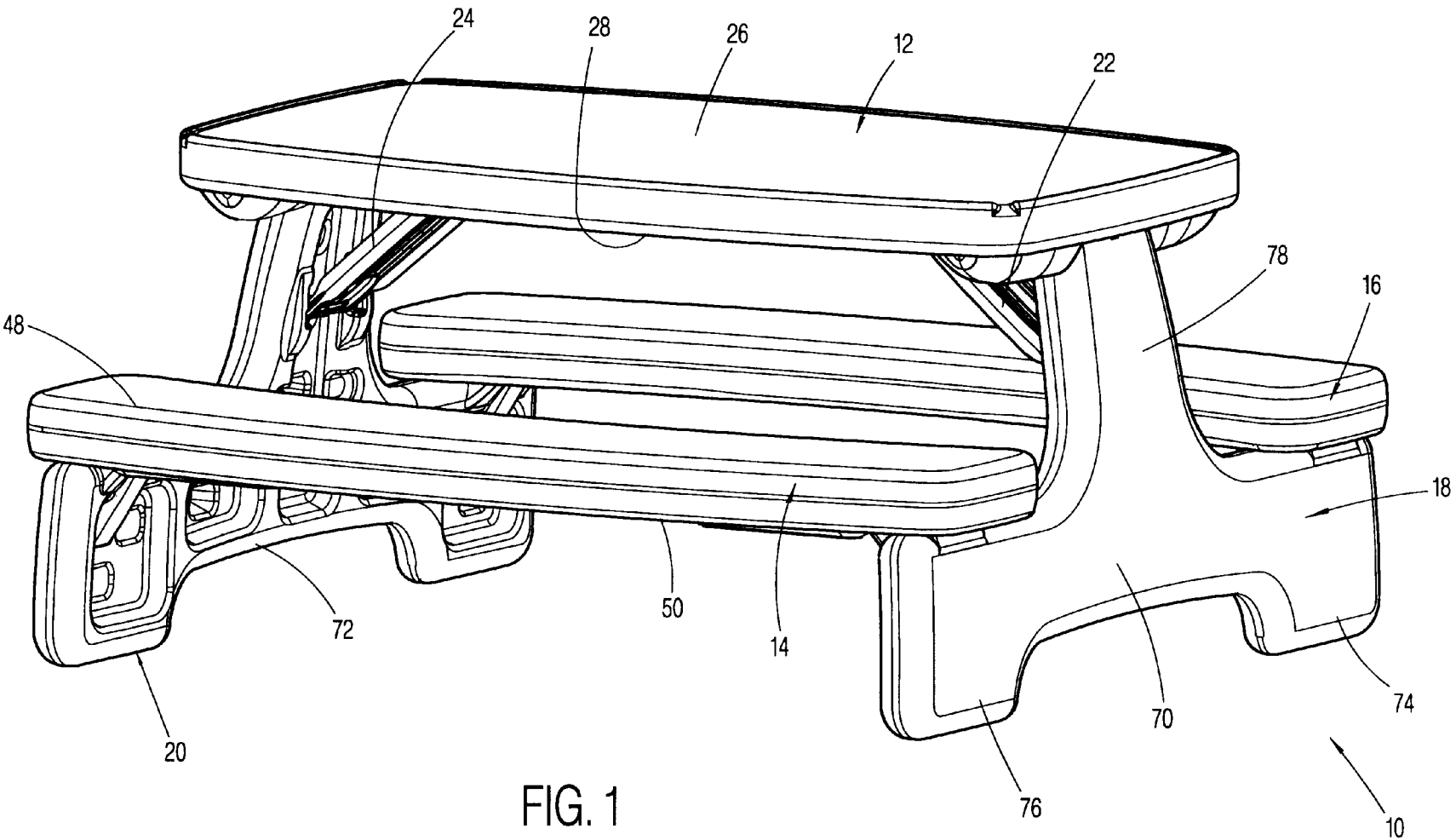
FIG. 1 is a front perspective view of the subject picnic table shown in the extended position.
Figure 2:
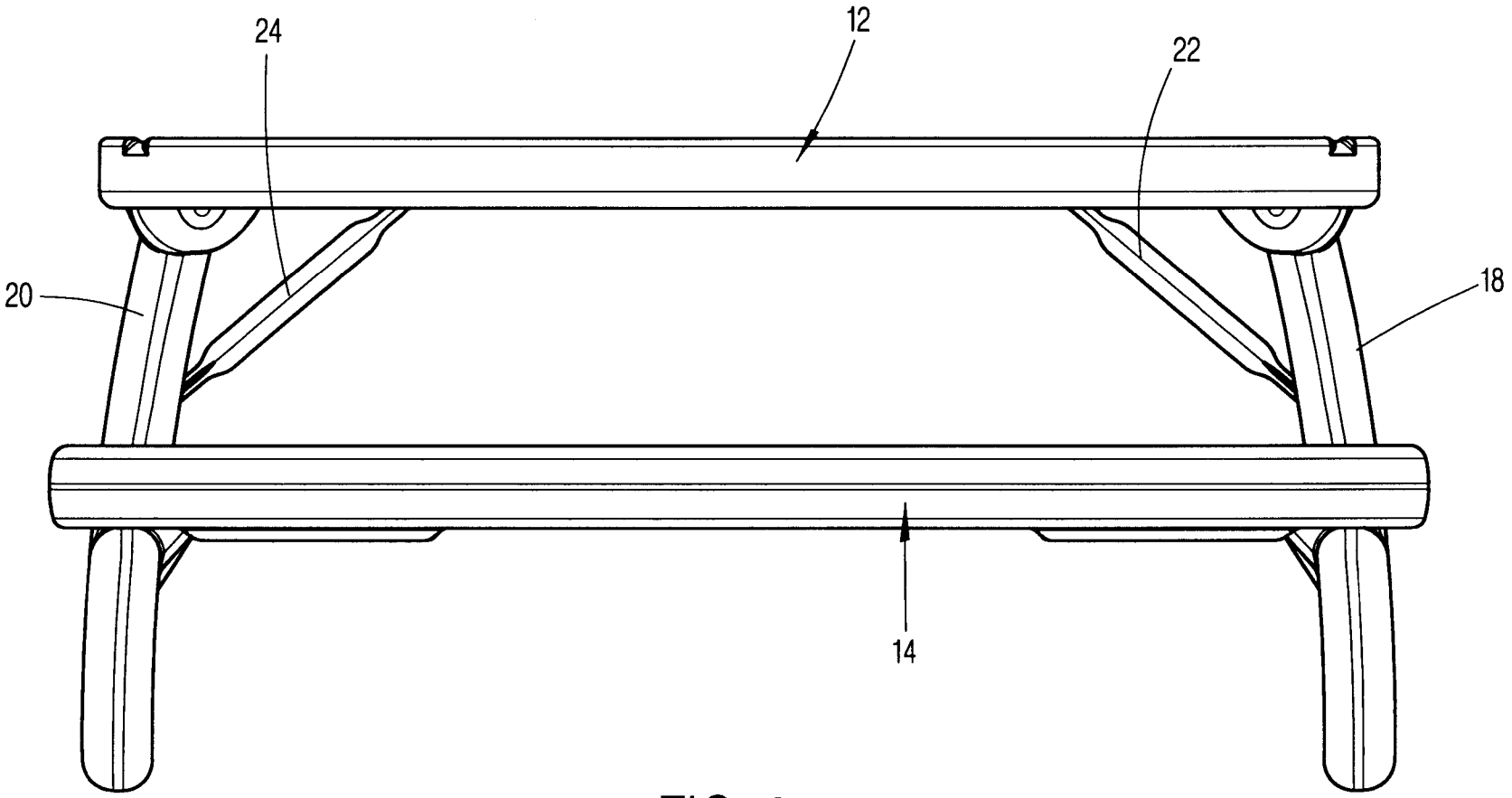
FIG. 2 is a elevational view thereof.
Figure 3:
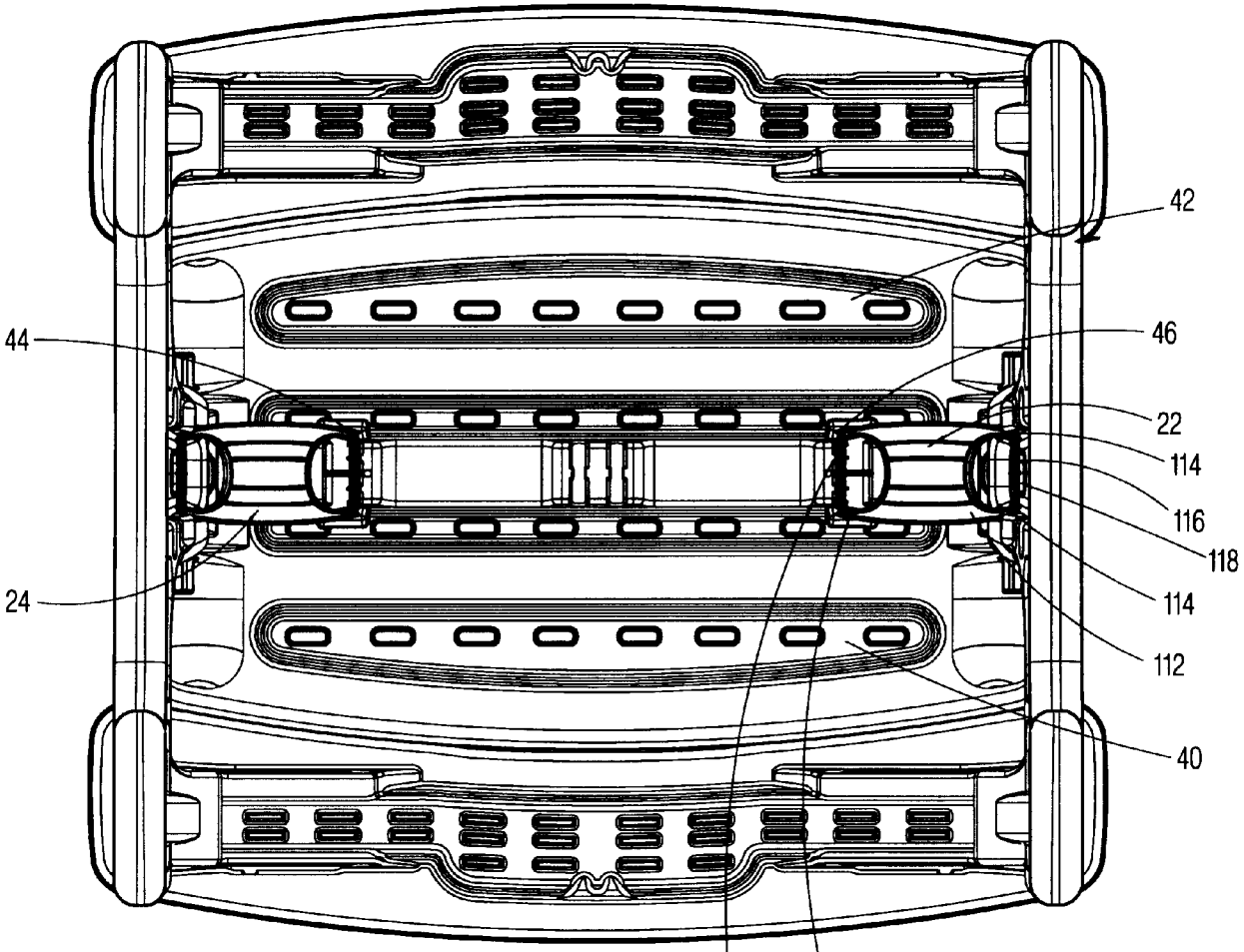
FIG. 3 is a is a bottom plan view thereof.
Figure 4:
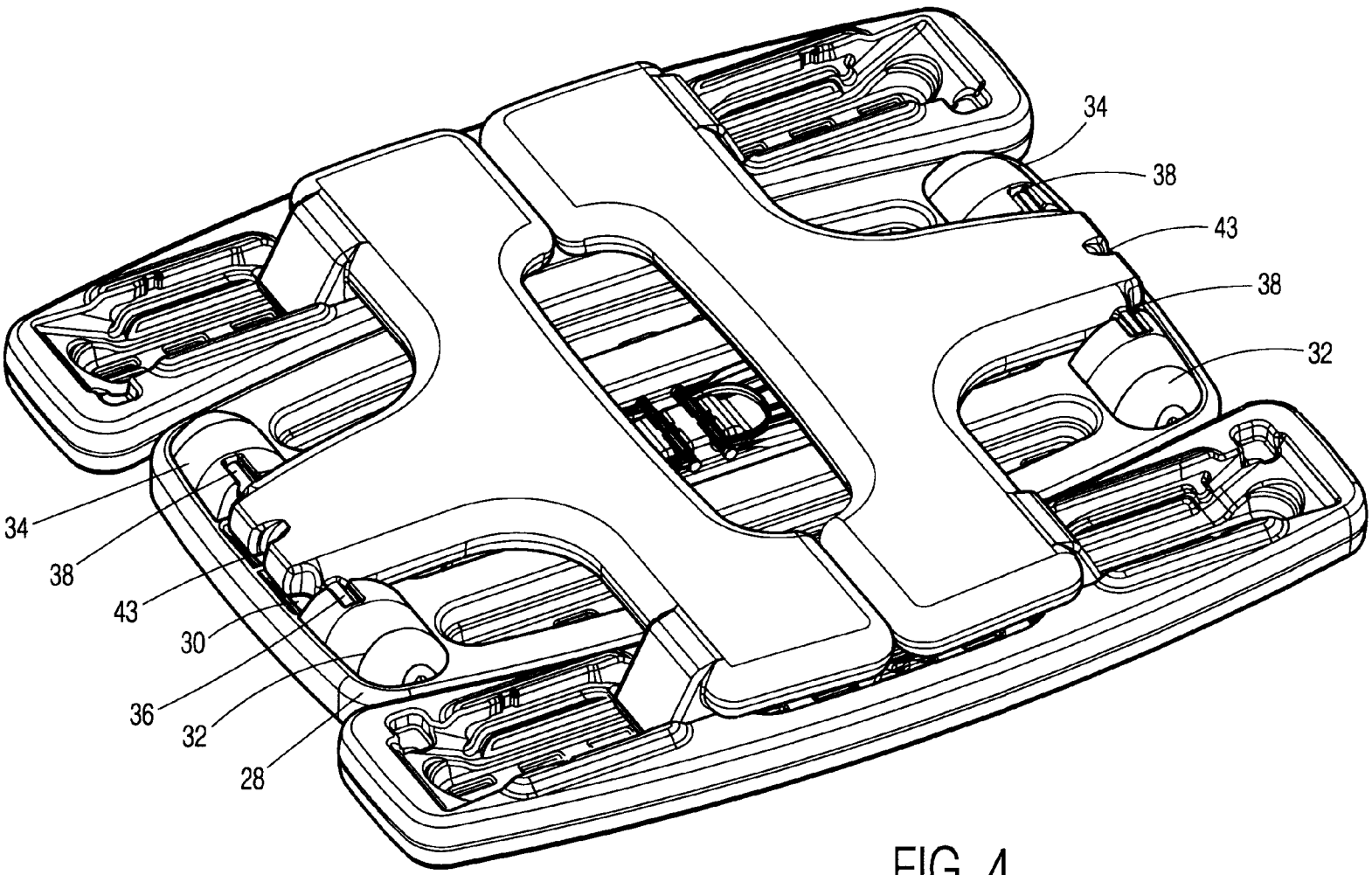
FIG. 4 is a bottom plan view of the picnic table shown in the collapsed condition.

Referring first to FIGS. 1 and 2, the subject collapsible picnic table 10 is seen to comprise the following structural components: a table top panel 12; two seat panels 14, 16; two end, or support, panels 18, 20; and pair of strengthening brace bars 22, 24. The components 12 through 20 inclusive are each preferrably formed by conventional blow molding of commercial grade plastic such as high density polyethylene. The bars 22, 24, in the preferred embodiment, are manufactured of injection molded plastic such as polypropylene. In addition, two plastic injection molded clasps 108 (FIG. 12) are provided as fastener attachments.

The components of the table are seen in FIGS. 1 and 2 to assembly into what is conventionally referred to as a "picnic" table, characterized by the table top 12 and seats 14, 16 attaching to the end panels 18, 20, and bars 22, 24 adding structural rigidity by rigidly connecting the table top 12 to each end panel 18, 20. The seats 14, 16 are affixed to the end panels 18, 20 as well, whereby the entire table 10 constitutes an integral unit.

With reference to FIGS. 1, 3, 4 and 9, the table top panel 12 comprises a top surface 26, an underside surface 28. A pair of recess channels 30 are formed in the underside surface, one at each end, defined by spaced apart shoulder protrusions 32, 34. A pair of pivot sockets 36, 38 extend into the shoulder protrusions 32, 34, respectively, with the sockets 36, 38 of each pair of protrusions 32, 34 in axial alignment. A depression, or socket 45 extends into the underside surface 28 between the shoulder protrusions 32, 34.

The table top panel 12, and the other blow molded components, are provided with multiple depressions extending into their respective underside surfaces. For example, elongate rectangular depressions 40, 42 are representative of such structure. Such depressions are conventional to the industry and serve to add structural rigidity to the blow molded part. FIGS. 1 through 6 show the placement and shapes of strengthening depressions; however, it will be known to those skilled in the art that alternative shapes or location of such depressions may be utilized to accomplish the intended purpose. A registration rib flange 43 is further provided at each end of the table underside surface 28, positioned between the protrusions 32, 34 for a purpose explained below. In addition, opposed socket depressions 44, 46 are formed in the surface 28, proximate the middle thereof. The sockets 44, 46 represent attachments points for the brace bars 22, 24.

Figure 9:
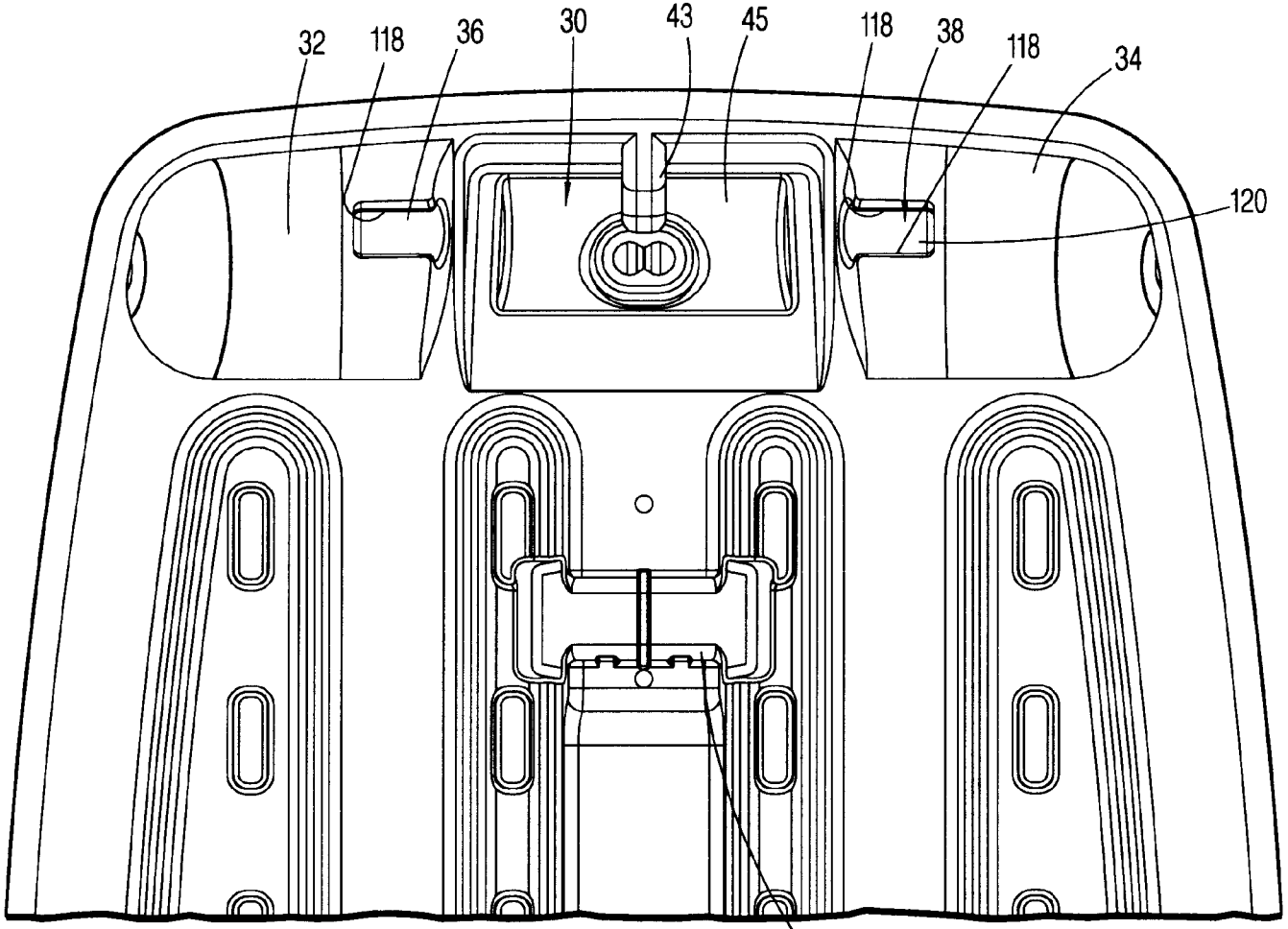
FIG. 9 is a plan view of an end of the table panel showing the pivot sockets.
Figure 10:
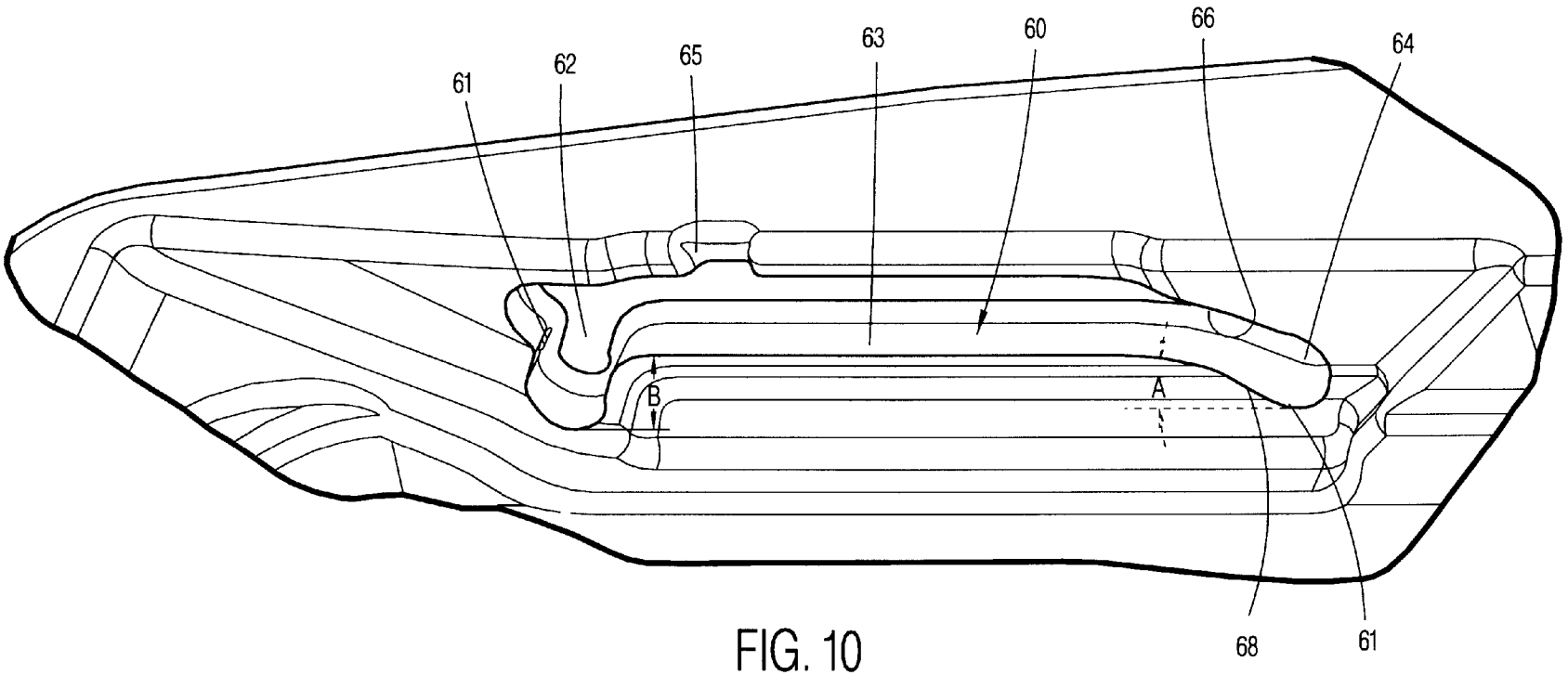
FIG. 10 is an enlarged plan view of the guide slot.
Figure 11:
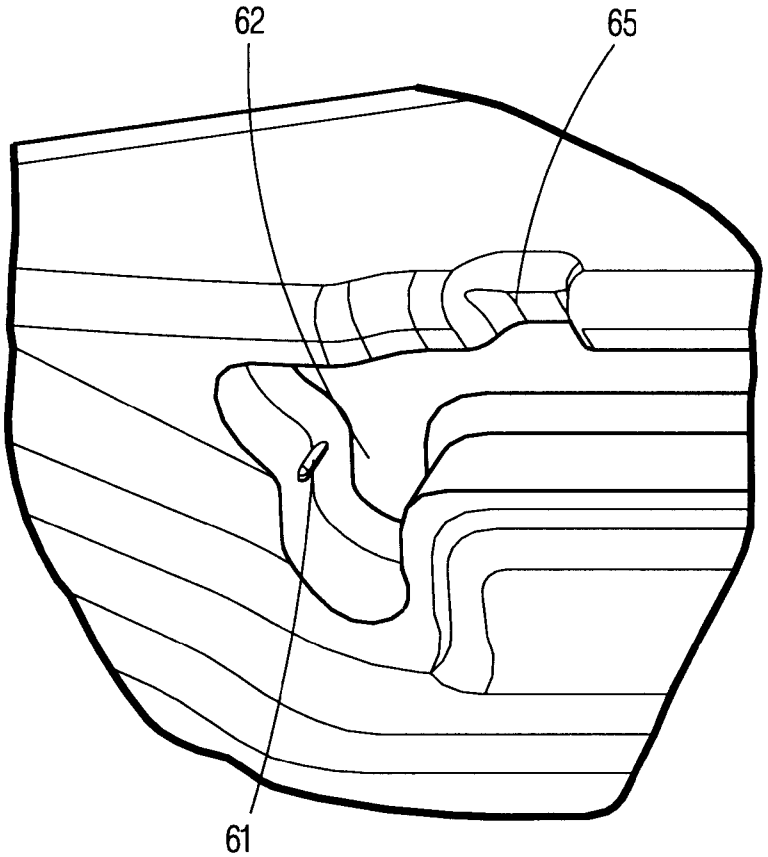
FIG. 11 is an enlarged plan view of an outer end of the guide slot.

As shown in FIGS. 1, 3, 4 and 5, each of the seat panels 14, 16 are identical and comprise a top planar surface 48 and a bottom surface 50. Each seat panel has two longitudinally extending, axially, channels 52, 54 formed to extend into the bottom surface 50, each channel defined by spaced apart and opposing sidewalls 56, 58. Extending into and along each sidewall 56, 58 is an elongate, generally U-shaped guide slot 60, formed to have an inner terminal end 62 and terminal end 64 and a bight portion 63. Each slot 60 is defined by slot sidewalls 66, 68. As represented in FIGS. 9, 10 and 11, the outer terminal end 64 is formed at a relatively shallow angle A, approximately twenty (20) degrees whereas the innerterminal end 62 forms a steeper angle B relative to the bight 63 of slot 60. Angle B is approximately sixty (60) degrees. The angles A and B of the terminal ends is set to control the degree of force necessary to fold and unfold the table as will be appreciated. The sidewall 66 of each slot 60 provides a detent protrusion 61 proximate each terminal end 62, 64 and an entry slot 65 extends downward along channel sidewall 56 to facilitate assembly of each seat to the end panels 18. 20.

Referring to FIGS. 1, 4, 5 and 6, the end, or support, panels 18, 20 are identical, and each comprises an outer surface 70 and an inner surface 72. Integrally formed at the bottom of each panel 18, 20 are spaced apart feet portions 74, 76. Each panel 18, 20 further includes an upwardly projecting upper neck portion 78. Two square shaped depressions 80, 81 are formed into the inner surface 72 of each panel at the feet portions 74, 76. Projecting upwardly from such portions 74, 76 are integrally molded, wedge shaped, support arms 82, 84. The wedge shaped arms 82, 84 project from the feet portions 74, 76 at a preferred angle of approximately forty-five (45) degrees. A molded strengthening brace 86, 88 extends diagonally from each brace 82, 84, respectively, into the depressions 80, 81, respectively.

Figure 8:
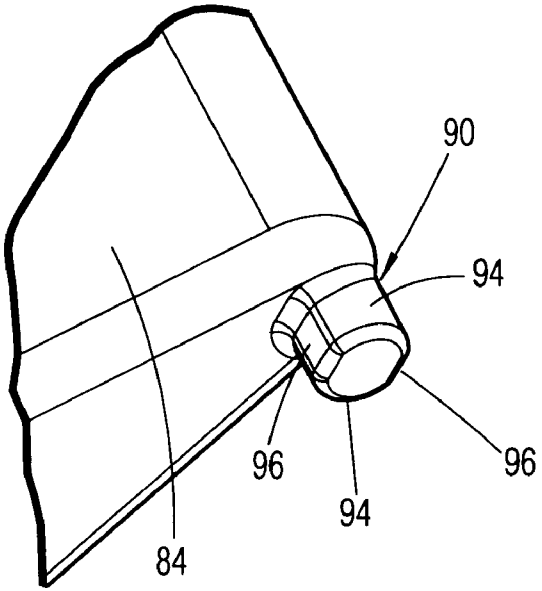
FIG. 8 is an enlarged perspective view of a lower portion of an end panel showing the coupling lug configuration.

Oppositely directed first and second coupling lugs 90, 92 project outward from an upper end of each arm 82, 84. As best seen in FIG. 8, the lugs 90, 92 are each generally cylindrical in shape, comprising circumferential radiussed outer surface portions 94, separated by two flat surfaces 96. The flat surfaces 96 of each lug 90, 92 are opposite to each other by 180 degrees. The lugs 90, 92 are oriented relative to the arms 84, 86 so as to place the flat surfaces 96 thereof in a normal orientation relative to the major plane of the end panels 18, 20, for a purpose explained below.

Figure 6:
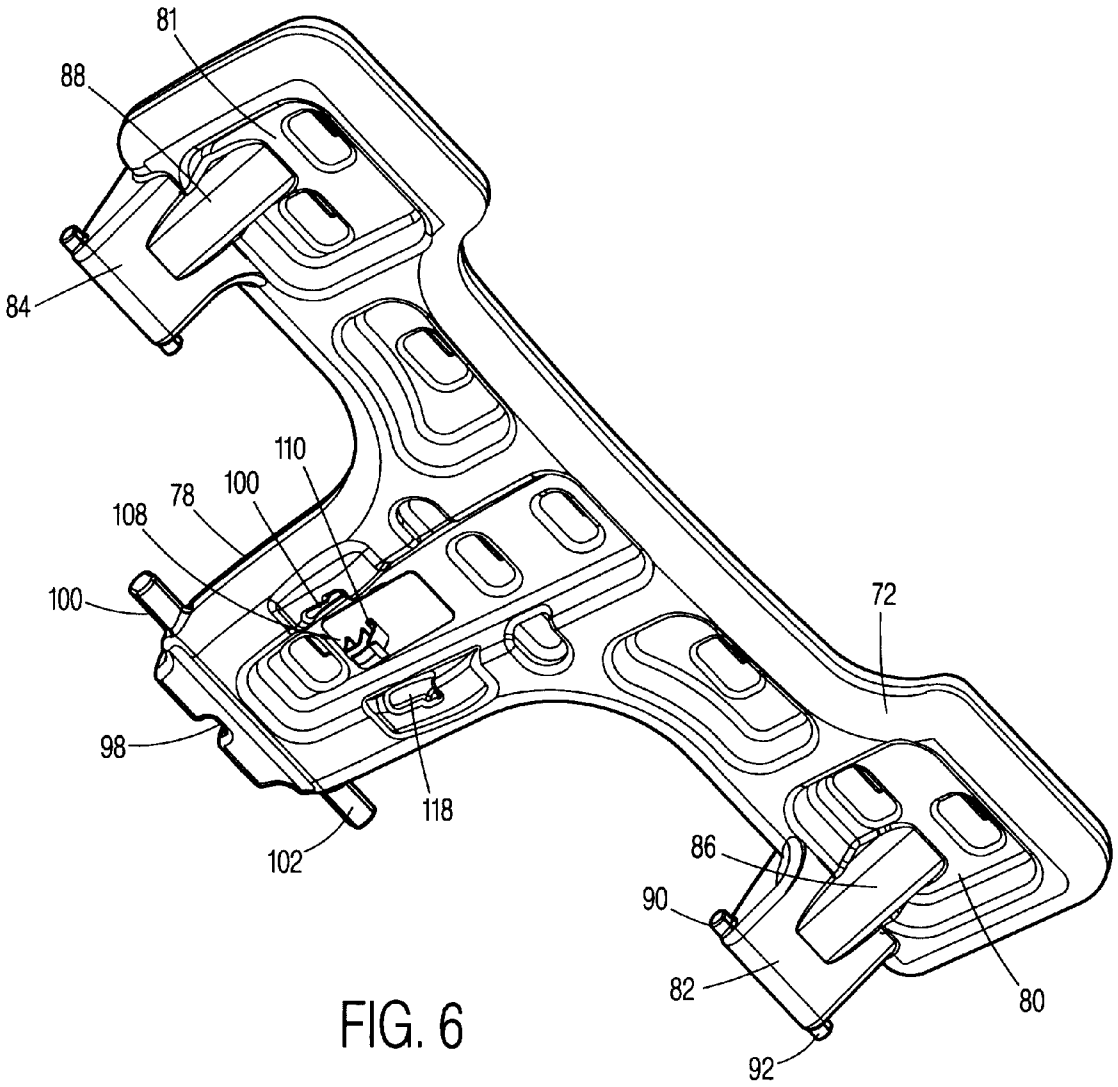
FIG. 6 is a bottom view of an end panel.
Figure 7:
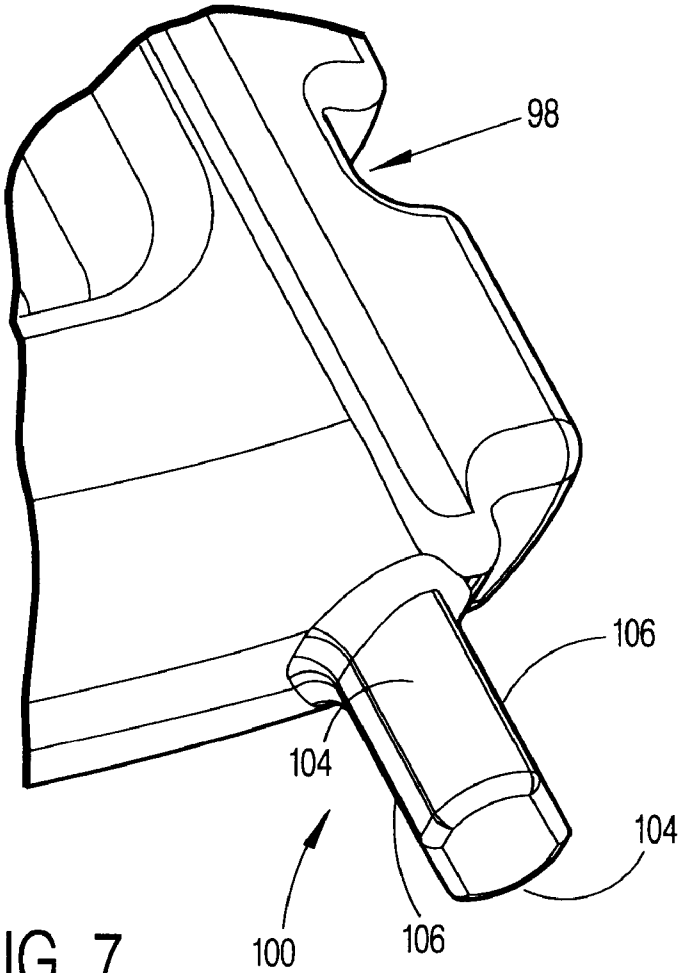
FIG. 7 is an enlarged perspective view of an upper portion of an end panel showing the pivot lug configuration.

An upwardly facing U-shaped notch 98 is formed in the upper end of neck portion 78, and a pair of oppositely directed pivot lugs 100, 102 project outwardly from portion 28 proximate the upper end. Lugs 100, 102, as seen from FIGS. 6 and 7, are structured analogously to lugs 90, 92, comprising radiussed circumferential surface portions 104 separated by first and second 180 degree opposite flat surfaces 106. The lugs 100, 102 are oriented so as to place the flat surfaces 106 at an approximate forty-five (45) degree angle relative to the major plane of the neck portion 78 for a purpose explained below. A separately molded clasp member 108 is formed to attach to and project inward from neck portion 78, and includes a channel 110.

Figure 12:
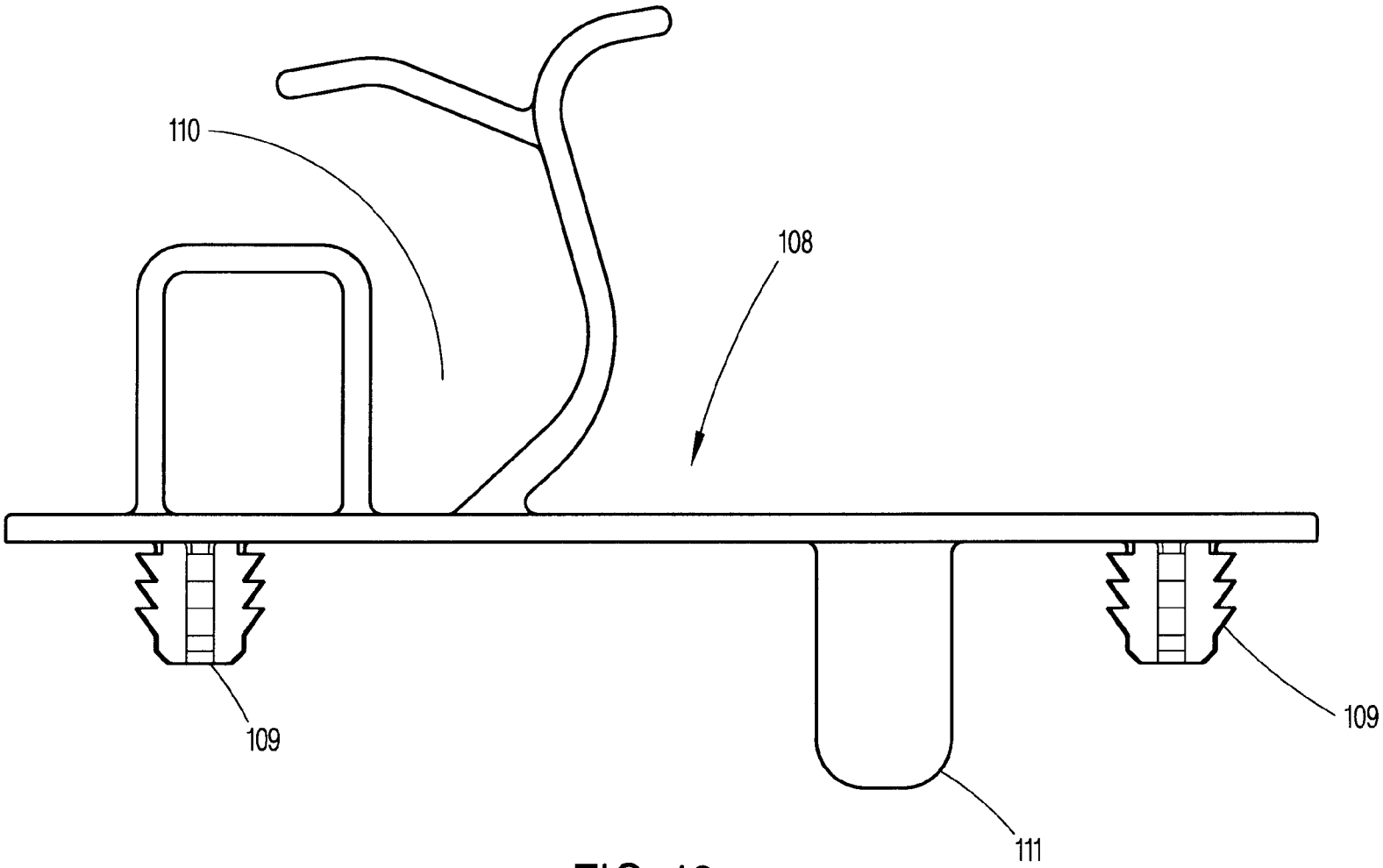
FIG. 12 is a side elevation view of the clasp component.

The two brace members 22, 24 are elongate plastic formed parts, having a central body panel 112 and a set of yoke arms 114 at opposite ends. A cross bar 116 spans each set of yoke arms. As seen from FIGS. 3, 4 and 5, the brace members 22, 24 attach at oppostite ends to the table panel 12 and the end panels 18, 20. The cross bars 116 at one end snap into molded sockets 44, 46 and at the opposite end into the a socket member 108. As shown in FIG. 12, the clasp member 108 is a separately molded member, having a pair of attachment barbs 109 which project through apertures in the end panels 18, 20. The clasp member 108 further has a channel 110 formed therein sized to receive and releasably retain one cross bar 116.

Figure 5:
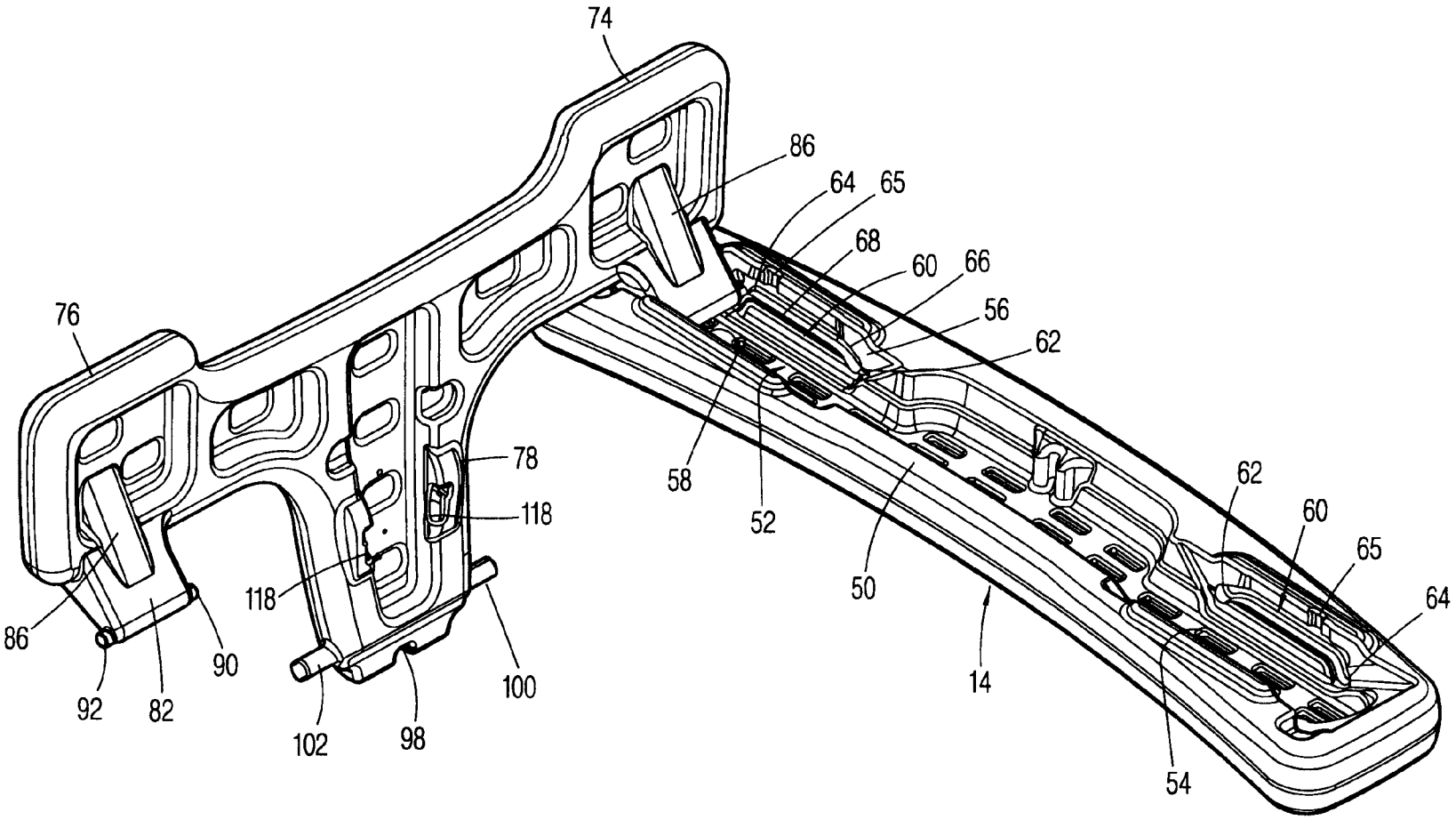
FIG. 5 is a bottom perspective view of an assembled end panel and seat panel.

Assembly and operation of the subject picnic table proceeds as follows. With reference to FIG. 5, the seat panels 14, 16 assemble to the end panels 18, 20 by insertion of support arms 82, 84 of each end panel into a respective channel 52, 54. The coupling lugs 90, 92 of each arm 82, 84 reside within the guide slots 60. Lug 90 is first inserted into its respective guide slot 60 and the opposite lug 92 is then aligned with and inserted downward through the entry slot 65 and into the with guide slot 60 on its respective side. Assembly of the seat panels to the end panels is thus accomplish with both seat panels resting upon portions 74, 76 of the end panels. The two sets of lugs 90, 92 of each end panel attach to respective seat panels 14, 16 and reside within guide slots 60.

So assembled, the lugs 90, 92 are free to reciprocally move along the slots 60 from the inner terminal end 62 to the opposite outer terminal end 64. Movement of end panels 18, 20 is thereby facilitated between a storage position represented in FIG. 4 and an extended position represented in FIGS. 1 and 2. In the storage position, 18, 20 are parallel and against the undersides of the seat panels, and the lugs 90, 92 reside at terminal ends 62 of slots 60. To extend the table, the panels 18, 20 are pivoted and lugs 90, 92 travel outward along slots 60 to the opposite terminal end 64. In the fully extended condition, the panels 18, 20 are substantially normal to the plane of the seat panels as shown in FIGS. 1 and 2.

Referring to FIGS. 8, 10 and 11, it will be appreciated that the configuration of the slots and lugs 90, 92 are such that the flat surfaces 96 of the lugs 90, 92 align against the sidewalls 66, 68 of the guide slot 60. As the lugs 90, 92 enter the terminal ends 62 and 64, they ride over the detent protrusion 61 located adjacent such ends and snap into place. The detent protrusions 61 serve to securely position the lugs 90, 92 in the terminal slot ends until intentionally released by a manual rotation of the end panels 18, 20. Further, the detent protrusions represent additional resistance which the lugs 90, 92 must overcome in order to escape from the terminal ends. Thus, detent protrusions 91 enhance the safety of the table, particularly in the upright or extended condition, when a sudden movement of the coupling lugs might bring an unexpected and unwelcome collapse of the table.

It will further be appreciated that the shape of the guide slot likewise serves to increase resistance to the coupling lugs 90, 92 escaping the terminal ends 62, 64 of the guide slot 60. The angle, or bend in the slot 60 at ends 62, 64 requires the coupling lugs to travel a non-linear path into and out of both the storage and extended positions. The force required to move the lugs against and along curved portions of slot 60 is greater than would be necessary were the guide track, or slot, linear. Thus, by increasing the force required to move the lugs between slot extremities, the liklihood of an inadvertant movement of the table from an extended condition or a storage condition is minimized.

Moreover, the angle at which the slot 60 curves or bends at the outer terminal end 64 is greater than that at the inner terminal end 62, further increasing the resistance against the lugs 90, 92 moving from terminal end 64. Since the presence of coupling lugs 90, 92 in terminal end 64 occurs when the table is in the extended, or in-use position, such an increase in resistance is desirable and further diminishes the possibility of an inadvertant collapse of the end panels.

Finally, it is the flat surfaces 96 of the lugs 90, 92 which abut and must ride over the detent protrusions 61 of the slot 60 before the lugs can leave the terminal ends thereof. The amount of force required to do so is greater than that necessary for a radiussed surface to ride over the protrusions 61. The increase in requisite force resulting from the flat surfaces 96 thus acts as a further safeguard against the lugs 90, 92 inadvertantly leaving their intended residence at either end of the slots.

Assembly of the table top panel 12 to the end panels 18, 20 proceeds as follows with reference to FIGS. 6, 7 and 9. The neck portion 78 of each end panel is inserted into channel 30 and into the depression 45, with the rib 43 of the table registering with the notch 98 of the neck portion 78. The sockets 36, 38 have an opening 120 to the inside dimensioned in width slightly less than the diameter of pivot lugs 100, 102. Accordingly, lugs 100, 102 are resiliently press inserted into the sockets 36, 38 through opening 120 and snap into place.

So assembled, the end panels 18, 20 may pivot about lugs 100, 102 between the collapsed and extended positions. The flat surfaces 106 of the lugs 100, 102 are positioned such that surfaces 106 align with the opening 120 in the sockets 36, 38 when the end panels are in the extended position. The flat surfaces 106 abut against the edges 118 (FIG. 9) defining the opening 120 and provide resistance to the lugs 100, 102 leaving the sockets 36, 38. The flat surfaces 106 thus enhance the structural integrity of the connection between the table top and the end panels. Moreover, the flat surfaces 106 of lugs 100, 102 act simultaneously with the flat surfaces 96 on lugs 90, 92 to prevent instability in the table at the precise moment when such stability is needed most; that is, when the table is in the extended or collapsed condition.

The brace members 22 are thereafter attached as described above, with cross bars 116 of the members 22 snapped into sockets 44 in the table top at one end, and into the slot 110 of the clasp member 108 at the opposite end. So positioned, brace members serve to reinforce and add structural rigidity the assembled table.

From the foregoing, it will be appreciated that the subject invention comprises relatively few component parts which can be readily assembled without attachment hardware or tools. Moreover, the picnic table folds between a flat orientation for storage and an extended condition for use in a convenient and user friendly manner. Also, the picnic table incorporates integral locking elements which serve to enhance resistance to the table in advertantly departing from either the extended or collapsed condition. The subject invention utilizes cooperative pivot and slide joints at the extended and collapsed positions to ensure that separation of the table components will not occur; nor will the table collapse unintentionally.

Finally, it will be appreciated that the subject table, while incorporating pivoting and sliding parts, does not create pinch points which could injure the user, particularly a young child. The mechanisms which effect pivotal movement of the side panels relative to the top panel do not create a pinch point risk; nor do the slide coupling mechanisms between the seat panels and the end panels. The safety of the subject table, from the absence of pinch points; the ease of assembly and transitional use between the extended and collapsed conditions; and the resistance of the table to inadvertant movement from the collapsed or extended conditions, represents significant utility to the user.

While the above describes the preferred embodiment of the invention, the invention is not intended to be so limited. Other embodiments, which will be apparent to those skilled in the art, which utilize the teachings herein set forth, are intended to be within the scope of the present invention.

What is claimed is:

1. A collapsing table comprising:

a table panel comprising a top surface and an underside;

at least one seat positioned adjacent a side of the table panel, the seat comprising a top surface and a bottom surface and an elongate guide channel extending into the seat bottom surface;

at least one support member comprising a first portion pivotally coupled to the table panel underside surface and reciprocally pivoting relative thereto between a collapsed position in which the support member is parallel and adjacent to the table panel and an extended position in which the support member is disposed at a prescribed angle to the table panel; and the support member comprising a coupling portion engaging the seat guide channel and reciprocally moving therealong as the support member moves between the collapsed and the extended positions.

2. A collapsing table according to claim 1, wherein further comprising a socket extending into an underside of the table panel; said socket being defined by sidewalls and dimensioned to receive and pivotally couple to the first portion of the support member.

3. A collapsing table according to claim 2, wherein the first portion of the support member comprises a generally cylindrical pivot lug.

4. A collapsing table according to claim 3, wherein the pivot lug is defined by circumferential radiused surface portions and at least one flat surface portion positioned to align in opposition to the sidewalls of the table panel socket with the support leg member in the extended position.

5. A collapsing table according to claim 1, wherein the elongate guide channel is defined by sidewalls which extend into the underside of the seat.

6. A collapsing table according to claim 5, wherein the elongate guide channel comprises at least one guide slot defined by slot sidewalls and extending into a side wall of the channel.

7. A table according to claim 6, wherein the guide slot is substantially U-shaped comprising opposite terminal ends and an intermediate bight portion; and the coupling portion of the support member comprises a coupling lug seated within the guide slot and traveling therealong.

8. A table according to claim 7, wherein the coupling lug is positioned at one terminal end of the guide slot when the leg member is in the extended position.

9. A table according to claim 8, wherein the coupling lug is substantially cylindrical, defined by circumferential radiussed surface portions and at least one flat surface portion positioned in opposition to the slot sidewalls slot when the support member is in the collapsed position.

10. A collapsing table comprising:

a table panel comprising a top surface and an underside surface;

at least one seat positioned adjacent a side of the table panel, the seat comprising a top surface and a bottom surface and an elongate non-linear seat guide track extending into the seat bottom surface;

at least one support panel comprising a first portion pivotally coupled to the table panel underside surface and reciprocally pivoting relative thereto between a collapsed position in which the support panel is adjacent the table panel and an extended position in which the support panel is disposed at a prescribed angle to the table panel; and the support panel comprising a coupling portion engaging the seat guide track and reciprocally moving therealong in a non-linear path as the support panel moves between the collapsed and the extended positions.

11. A collapsing table according to claim 10, wherein the coupling portion of the support panel reaches a first terminal end of the seat guide track when the support panel reaches the extended position.

12. A collapsing table according to claim 11, wherein the coupling portion of the support panel reaches an opposite terminal end of the seat guide track when the support panel reaches the collapsed position.

13. A collapsing table according to claim 10, wherein the seat guide track comprises at least one guide slot extending into a sidewall of the seat guide track.

14. A collapsing table according to claim 13, wherein the guide slot is substantially U-shaped.

15. A collapsing table according to claim 14, wherein the coupling portion of the support panel comprises at least one coupling lug seated within the guide slot and traveling therealong.

16. A collapsing table according to claim 10, wherein a socket defined by sidewalls extends into the table panel underside and the first portion of the support panel is received by the socket and pivotally coupled thereto.

17. A collapsing table according to claim 16, wherein the first portion of the support panel comprises a generally cylindrical pivot lug.

18. A collapsing table according to claim 17, wherein the pivot lug is defined by circumferential radiussed surfaces and at least one flat surface portion positioned to align in opposition to the sidewalls of the table panel socket when the support panel reaches the extended position.

19. A collapsing table according to claim 18, wherein the coupling portion of the support panel reaches a first terminal end of the seat guide track when the support panel reaches the extended position.

20. A collapsing table according to claim 19, wherein the coupling portion of the support panel reaches an opposite terminal end of the seat guide track when the support panel reaches the collapsed position.

21. A collapsing table according to claim 20, wherein the seat guide track comprises at least one guide slot extending into a sidewall of the seat guide track.

22. A collapsing table according to claim 21, wherein the guide slot is substantially U-shaped.

23. A collapsing table according to claim 22, wherein the coupling portion of the support panel comprises at least one coupling lug seated with the guide slot and travelling therealong.

24. A collapsing table comprising:

a table panel comprising a top surface and an underside;

at least one seat positioned adjacent a side of the table panel, the seat comprising a top surface and a bottom surface and an elongate guide channel extending along the seat bottom surface;

at least one support member comprising a first portion pivotally coupled to the table panel underside surface and reciprocally pivoting relative thereto between a collapsed position in which the support member is parallel and adjacent to the table panel and an extended position in which the support member is disposed at a prescribed angle to the table panel; and the support member comprising a coupling portion engaging the seat guide track and reciprocally moving therealong as the support leg member moves between the collapsed and the extended positions;

a socket defined by sidewalls and extending into the table panel underside;

a pivot lug connected to the first portion of the support member and residing within the socket, the pivot lug having circumferential radiussed surfaces and at least one flat surface positioned to align in opposition to the socket sidewalls when the support member reaches in the extended position.

25. A collapsing table according to claim 24, wherein the elongate channel is defined by channel sidewalls and which extend into the seat bottom surface; and wherein the seat guide channel comprises at least one guide slot defined by guide slot sidewalls and which extend into a sidewall of the channel.

26. A collapsing table according to claim 25, wherein the coupling portion of the support member comprises a coupling lug seated within the guide slot and travelling therealong, and the coupling lug comprising circumferential radiussed surfaces and at least one flat surface positioned to align in opposition to a guide slot sidewall when the support member reaches the extended position.

27. A collapsing table according to claim 26, wherein the coupling lug and the pivot lug each have a second flat surface positioned to align in opposition to a guide slot sidewall and a socket sidewall, respectively, when the support member reaches the collapsed position.

28. A collapsing table according to claim 26, wherein the guide slot is non-linear, whereby the path traveled by the coupling lug is non-linear.

29. A collapsing table according to claim 28, wherein the guide slot is substantially U-shaped.

* * * * *